US005355598A

United States Patent [19]

Yao

[11] Patent Number: 5,355,598

[45] Date of Patent: Oct. 18, 1994

[54] DEVICE FOR AUTOMATICALLY MARKING, IRONING, HEMMING AND CUTTING FABRIC

[75] Inventor: Shin-Chau Yao, Taipei, Taiwan

[73] Assignee: China Textile T&R Institute, Taipei, Taiwan

[21] Appl. No.: 101,002

[22] Filed: Aug. 3, 1993

[51] Int. Cl.[5] ..... D06F 69/00; D05B 21/00; A41H 42/00; B26D 5/12

[52] U.S. Cl. ..... 38/2; 112/121.11; 112/121.25; 223/2; 83/609; 83/901

[58] Field of Search ..... 38/1 R, 2, 7, 8; 112/121.11, 121.14, 121.29, 131, 305, 307, 312, 322; 83/607, 609; 223/2, 3, 4

[56] References Cited

U.S. PATENT DOCUMENTS

| | | | |
|---|---|---|---|
| 3,722,435 | 3/1973 | Elsas | 112/121.11 |
| 3,731,577 | 5/1973 | Swint, Jr. | 83/609 X |
| 3,888,395 | 6/1975 | Burt, Jr. et al. | 38/2 X |
| 4,589,761 | 5/1986 | Starnes et al. | 112/305 X |
| 4,621,585 | 11/1986 | Ball et al. | 112/121.11 X |
| 4,688,499 | 8/1987 | Moore et al. | 112/121.29 X |
| 4,856,439 | 8/1989 | O'Neal et al. | 112/121.29 X |
| 4,962,712 | 10/1990 | Sotome et al. | 112/307 X |

*Primary Examiner*—Clifford D. Crowder
*Assistant Examiner*—Ismael Izaguirre
*Attorney, Agent, or Firm*—Morton J. Rosenberg; David I. Klein

[57] ABSTRACT

A continuous ironing and automatic cutting apparatus, is provided. The apparatus mainly makes use of a cloth roll stand, a marking device, a few sets of buffering devices, and an automatic cutting device, in cooperation a conventional pressing device and a corking device, to accomplish a continuous ironing and automatic cutting operation.

5 Claims, 12 Drawing Sheets

DEVICE FOR AUTOMATICALLY MARKING, IRONING, HEMMING AND CUTTING FABRIC

BACKGROUND OF THE INVENTION

A conventional process for ironing apparel linings is to manually place linings on strips of cloth one after another, and align them in pairs. These paired fabrics are put into a pressing machine for ironing and then collected in back of the machine. Pressed fabrics are further cut, corked, and hemmed for use in collars, cuffs, flaps, and tops of trousers. Obviously such a manual process takes much more time and manpower than an automated process, and is not cost effective.

Moreover, in a conventional manual process, placing strips of cloth on linings without a reference frequently leads to misalignments and unequal spans, thus resulting in wasted linings and a high percentage of defects in a sequential cutting processing.

Therefore, it is the primary object of the invention to provide a continuous ironing and automatic cutting apparatus, in which the lining fabric, which is rolled up in a cylindrical form and placed on a stand, is driven to move forward and marked thereon at a fixed length by a marking device. After passing through buffering devices, the lining fabric, with a strip of cloth placed thereon by operators in front of a pressing device, in alignment with imprinted marks on the lining fabric, is further delivered into the pressing device. After being ironed, the fabric is transferred through a buffering device and into a corking device for hemming and then into an automatic cutting device where the lining fabric is cut into pieces as required. Thus, obtaining advantageous effects of saving manpowers, reducing scrap material, and production by automation.

BRIEF DESCRIPTION OF THE DRAWINGS

The structure, features, and advantages of the invention will be apparent from the following description of the invention when read in conjunction with the accompanying drawings, in which.

DETAILED DESCRIPTION OF THE PREFERRED EMBODIMENTS

Figure 1:
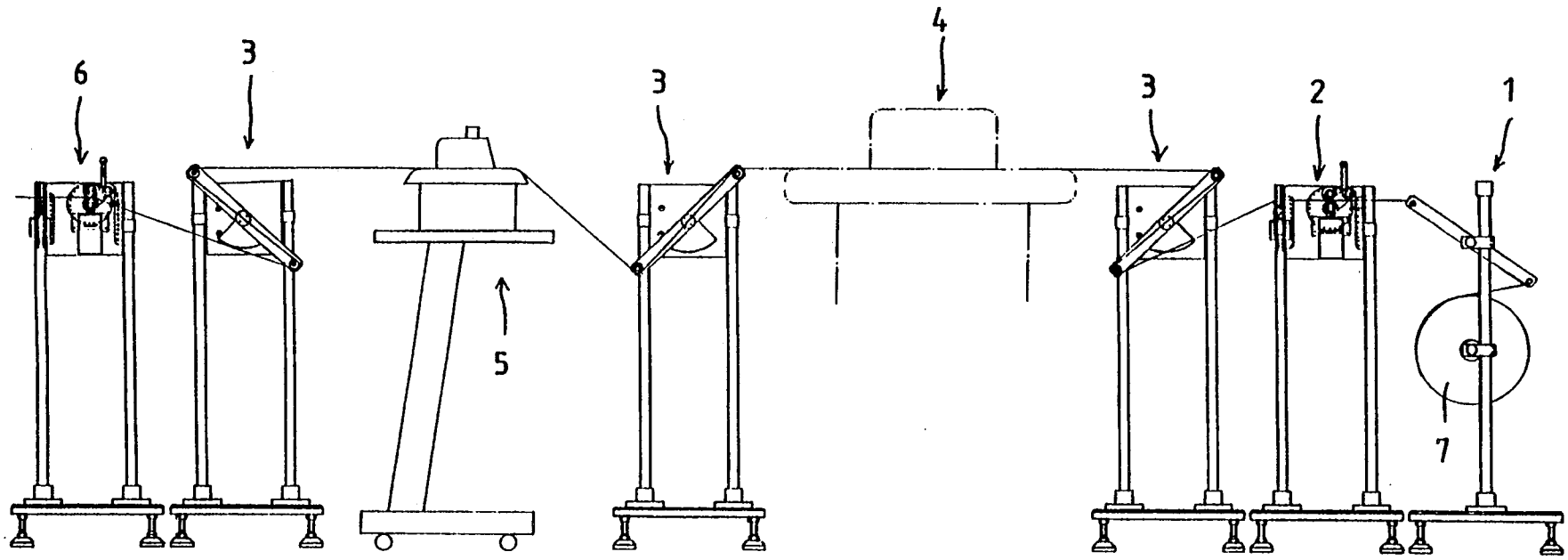
FIG. 1 is a schematic view showing an embodiment of the continuous ironing and automatic cutting apparatus of the invention.

FIG. 1 shows the construction of an embodiment of the continuous ironing and automatic cutting apparatus, in which provided in front of a conventional pressing device 4 are a cloth roll stand 1, a marking device 2, and a buffering device 3. Two buffering devices 3, of the same type, are respectively installed between the pressing device 4 and a hemming device 5 and between the hemming device 5 and an automatic cutting device 6, which is further disposed in back of the third buffering device 3.

Figure 2:
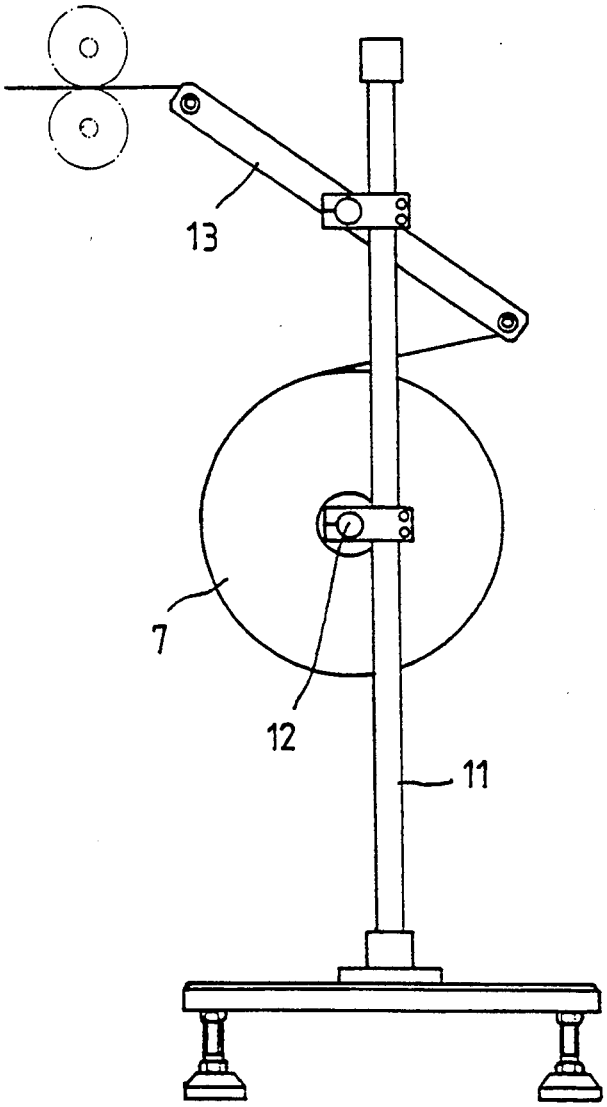
FIG. 2 is a plan view of the cloth roll stand of the preferred embodiment of FIG. 1.
Figure 3:
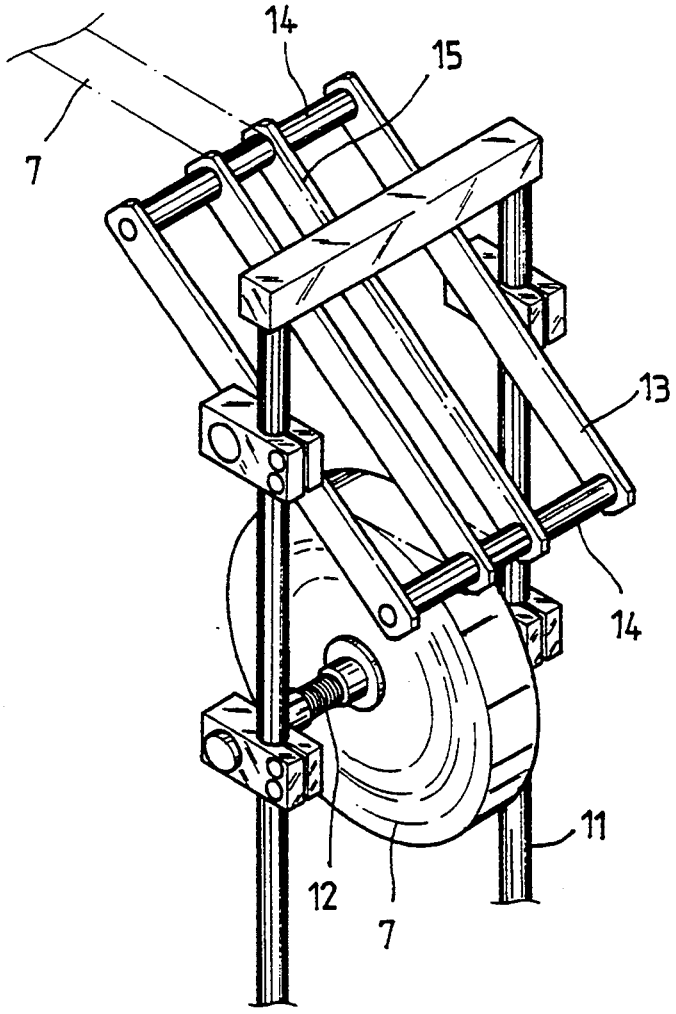
FIG. 3 is a side view showing the structure of the cloth roll stand of FIG. 2.

Referring to FIGS. 2 and 3, a cloth roll stand 1 of the embodiment comprises two upright columns 11, each with a middle segment to which a mandrel 12 is attached for mounting cloth rolls 7 thereon. Situated on the upper portion of the stand is a pair of inclined frames 13. The two ends of the pair of inclined frames are linked by two transverse bars 14. Two partitions 15 are movably mounted on the transverse bars 14, so as to enable the distance between the partitions to be adapted for the cloth 7 that is to pass over the transverse bars 14 and fed to the marking device 2 along the channel defined by the partitions when the apparatus of the invention operates.

Figure 4:
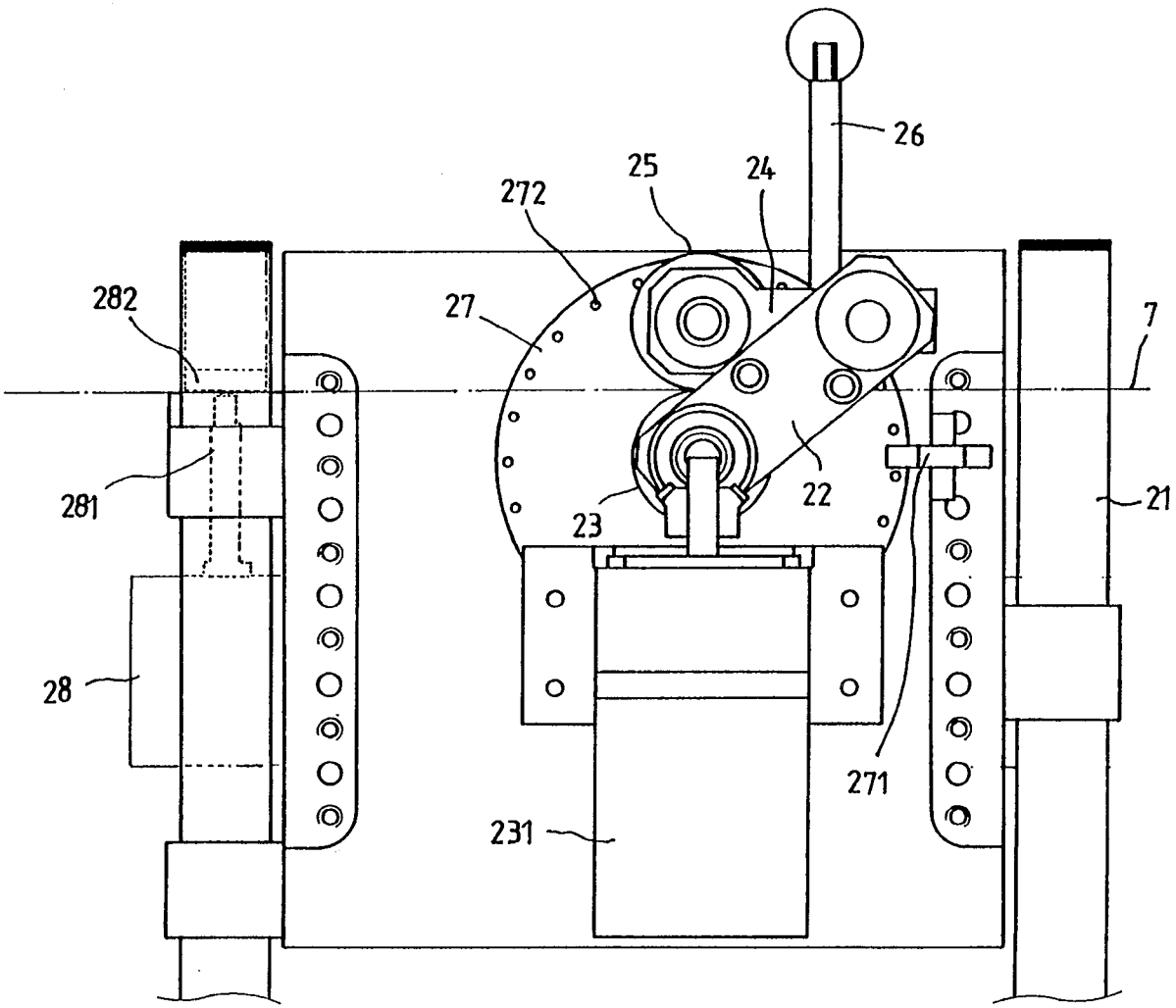
FIG. 4 is a plan view of the marking device of the preferred embodiment of FIG. 1.
Figure 5:
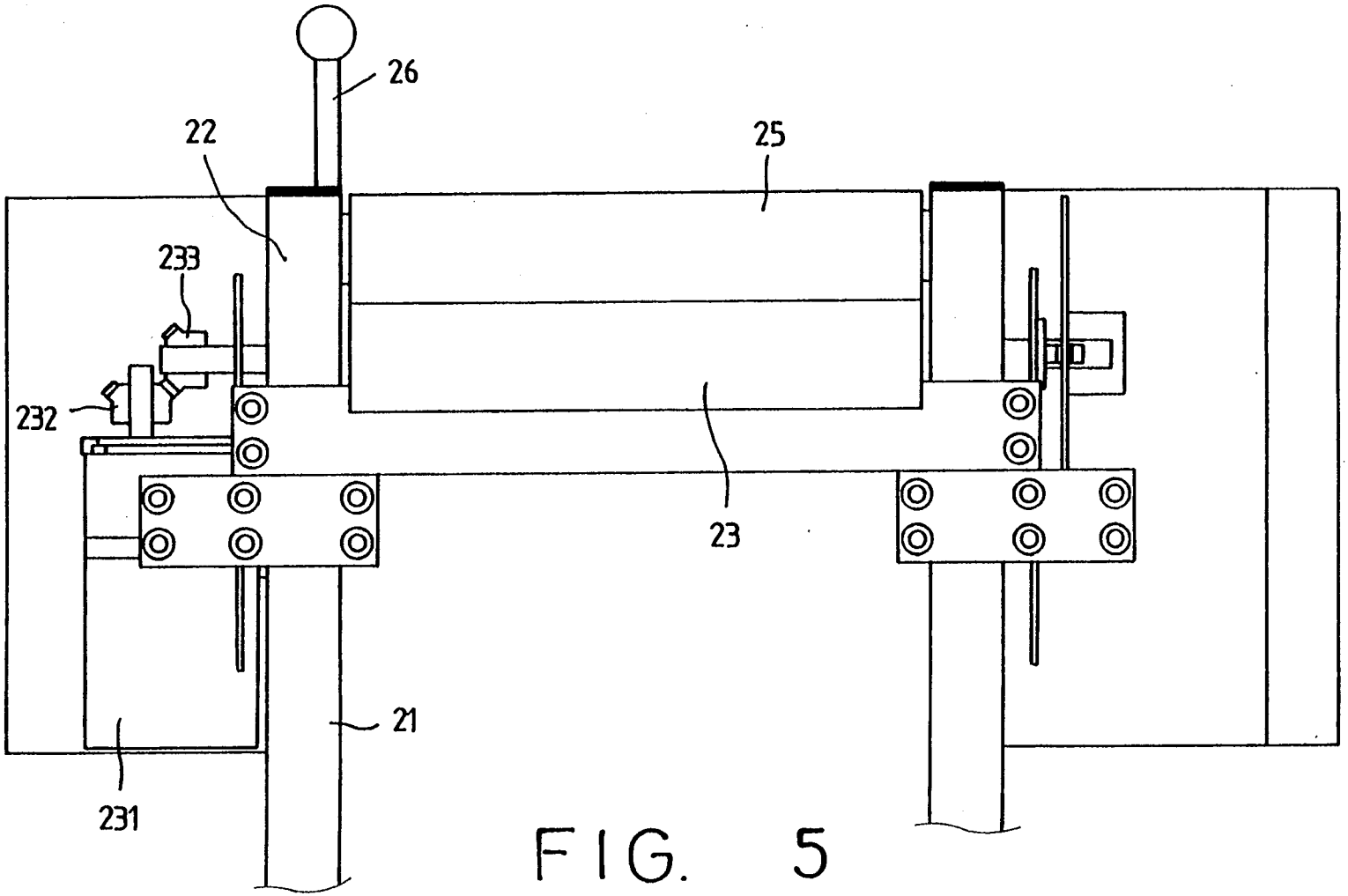
FIG. 5 is a side view of the marking device of FIG. 4.
Figure 6:
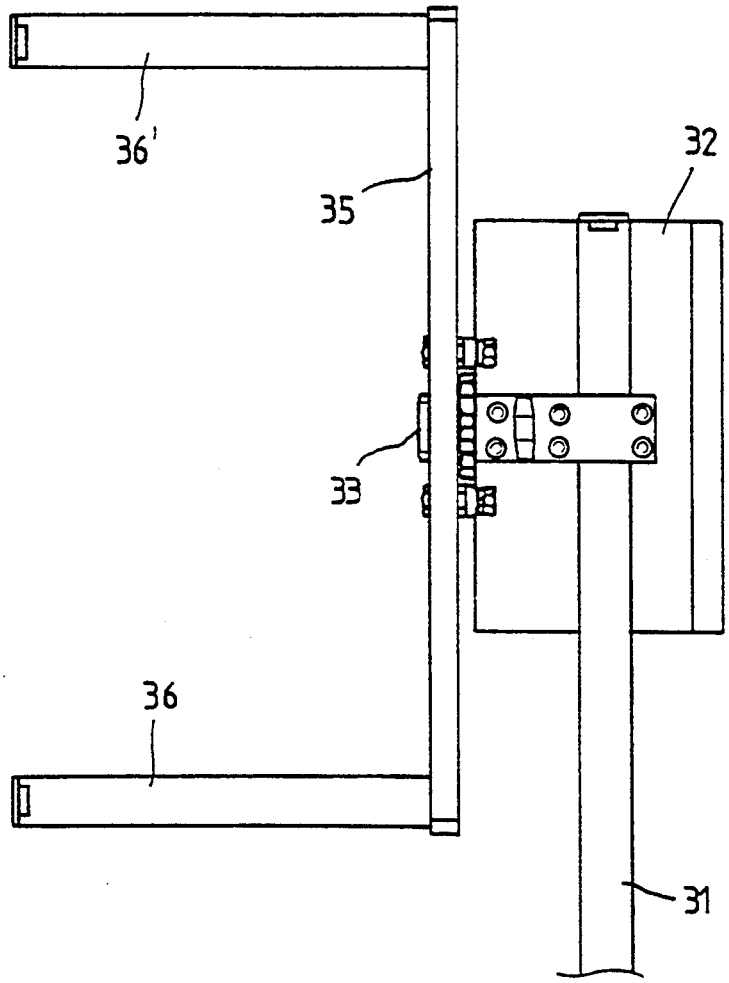
FIG. 6 is a plan view of a buffering device of the preferred embodiment of FIG. 1.
Figure 7:
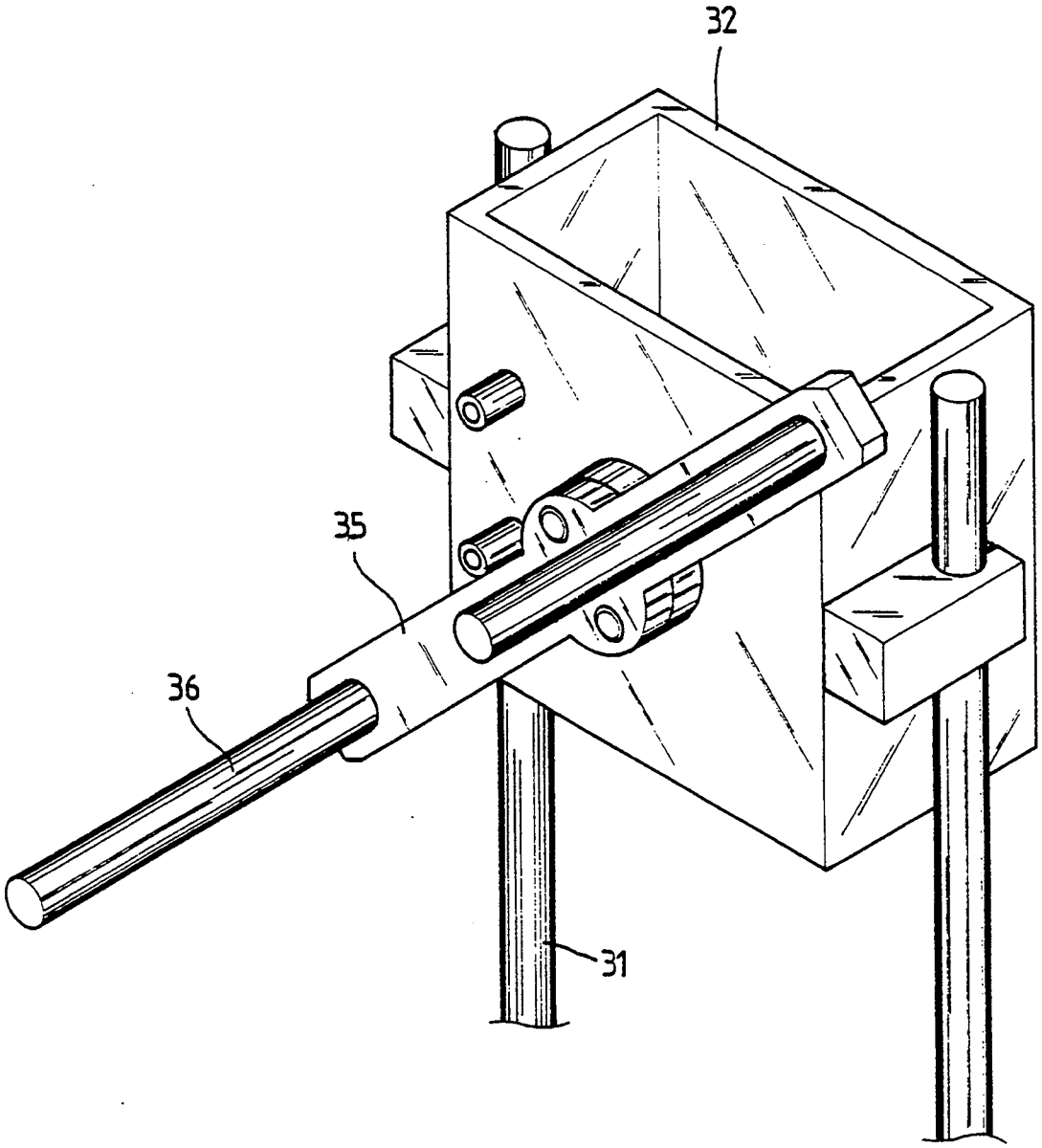
FIG. 7 is a perspective view illustrating the structure of the buffering device.
Figure 8:
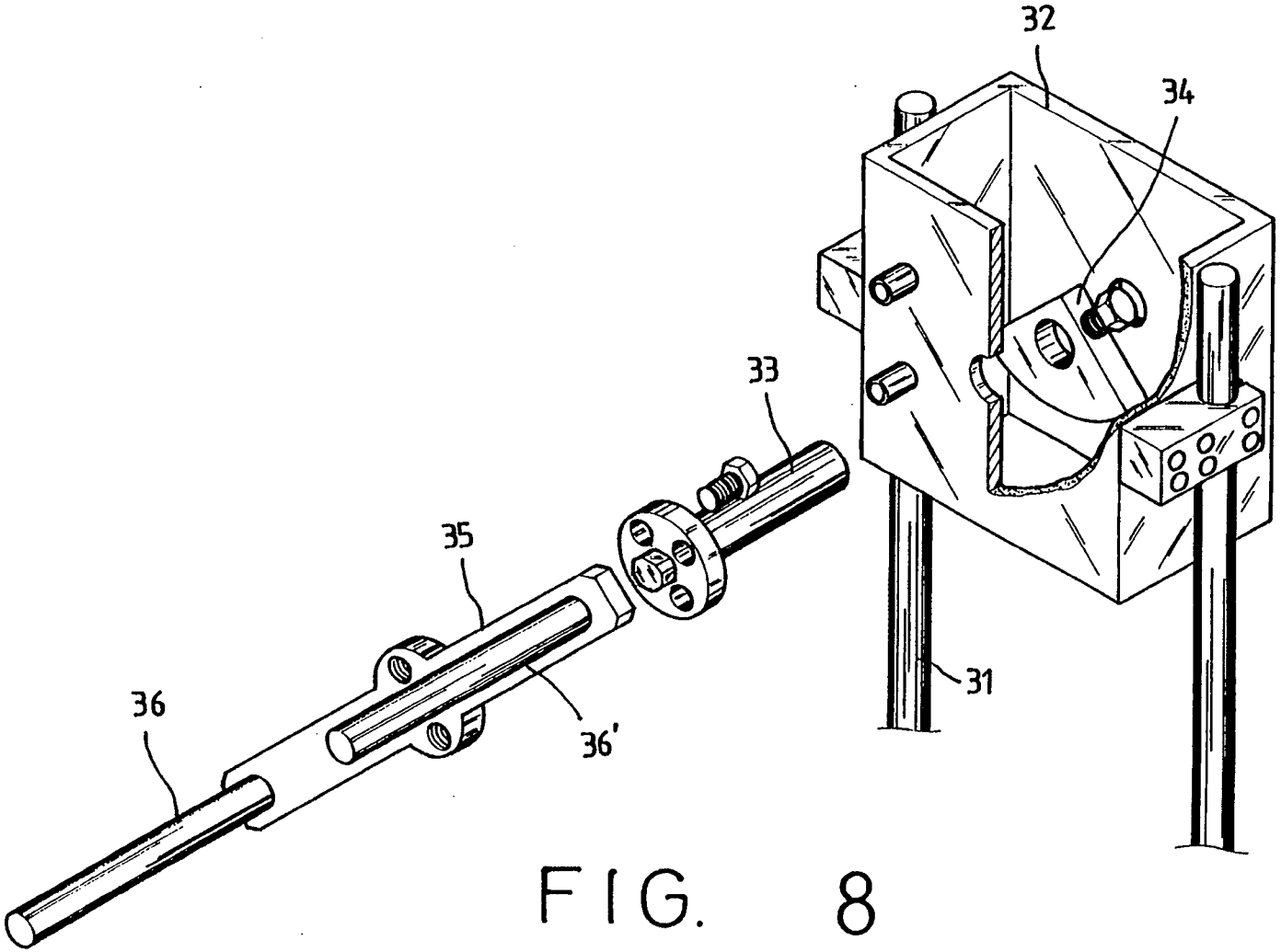
FIG. 8 is an exploded perspective view of the buffering device indicating the arrangement of varied components.
Figure 9:
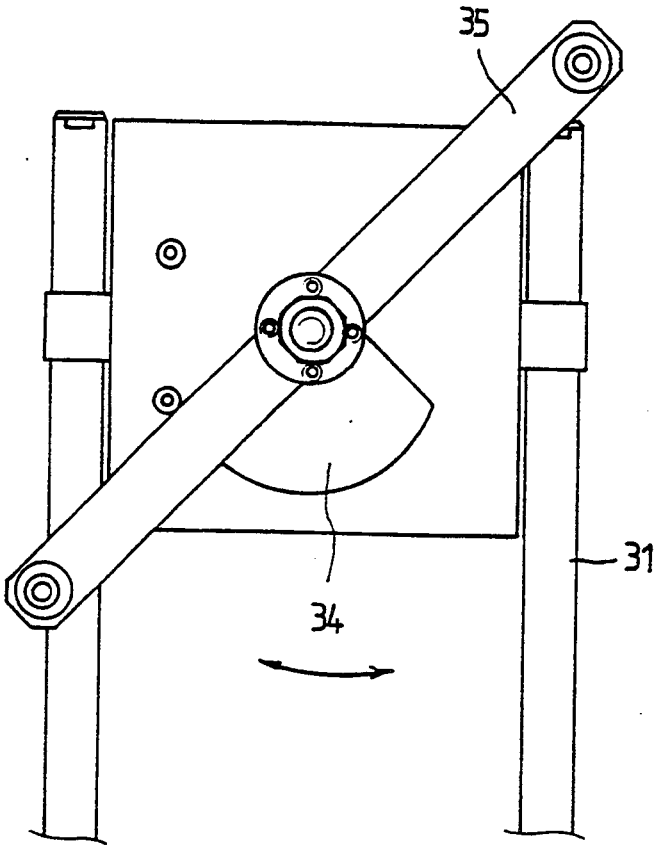
FIG. 9 is a side view of the buffering device of FIG. 6.

Referring to FIGS. 4 and 5, the marking device 2 of the embodiment generally comprises two columns 21 disposed on two sides thereof. A bearing seat 22 is provided on the upper portion of the columns, connected at one end to a rotary axle 23, and coupled at the other end to a crank arm 24. A driven axle 25 is attached to one end of the crank arm 24 and rests against the rotary axle 23. To route cloth 7 through the roller set defined by these two axles, a lever 26 provided on the crank arm 24 and extending upwards therefrom is pulled to separate the driven axle 25 from the rotary axle 23 to receive cloth. Subsequently, the lever 26 is returned to its original position, which will make two axles 23, 25 firmly clamp the cloth 7. A motor 231 fixed on one side of a column 21 drives the rotary axle 23 through two bevel gear sets 232, 233. A photoelectric switch 271 is secured to the column 21. A dividing disk 27 having a plurality of equidistantly spaced small holes 272 disposed on the circumference thereof and aligned with the sensor of the photoelectric switch is installed on one side of the rotary axle 23. Located behind the columns is an air cylinder, one end of which is attached to a punch. Above the punch is a stamping board. As the axles drive the cloth to pass over the space between the punch and the stamping board, a predetermined setting made on the photoelectric switch will urge the punch moving upwards to equidistantly imprint marks on cloth.

Generally the running speed of pressing devices 4 is different from that of hemming devices 5 and so buffering devices 3 are arranged in front and back to slow the hemming device 5 down for smoothing the operation of the whole apparatus.

As is shown in FIGS. 6–9, each of the buffering devices 3 of the invention consists of a set of columns 31 with an enclosure 32 mounted on the upper portion thereof. A center axle 33 is installed through the central portion of the enclosure 32, and a sector shaped weight 34 mounted on the center axle 33 and located inside the enclosure 32. A swing plate 35 is pivotally connected to the outer end of the center axle 33 and two guide rods 36, 36' are supported on the ends thereof. As the swing plate 35 oscillates and deviates from its balance position, the sector's weight will pull the swing plate back to its original position. Cloth 7 moves along guide rods 36, 36' and, with the aid of the buffering devices 3, continuously and steadily enters a pressing device 4. Operators can correctly place strips of cloth on cloth 7, following the stamped marks, before cloth 7 enters the pressing device 4, thus obtaining an expected effect of correctly positioning strips of cloth.

Figure 10:
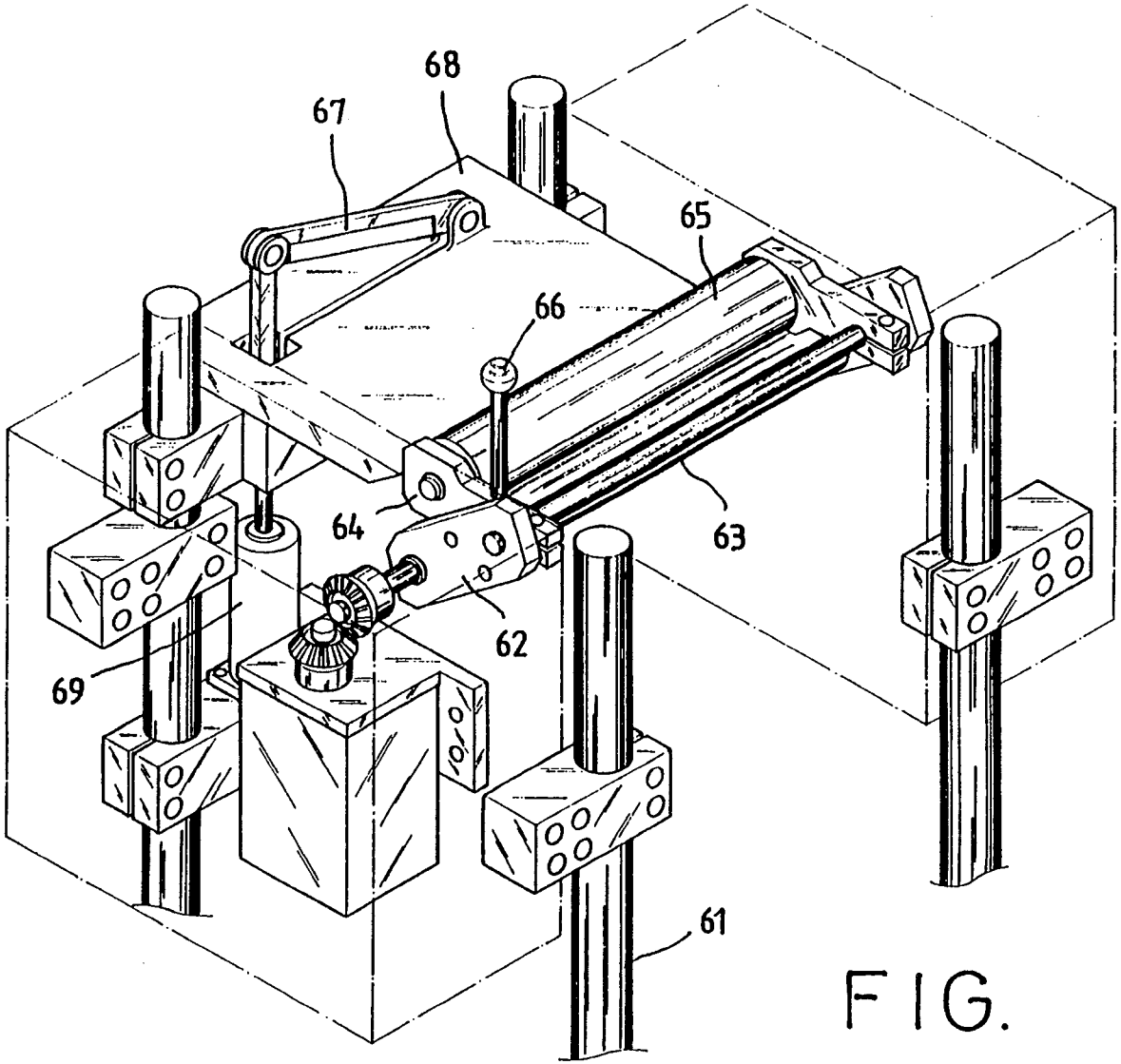
FIG. 10 is a perspective view schematically showing the cutting device of the preferred embodiment of FIG. 1.
Figure 11:
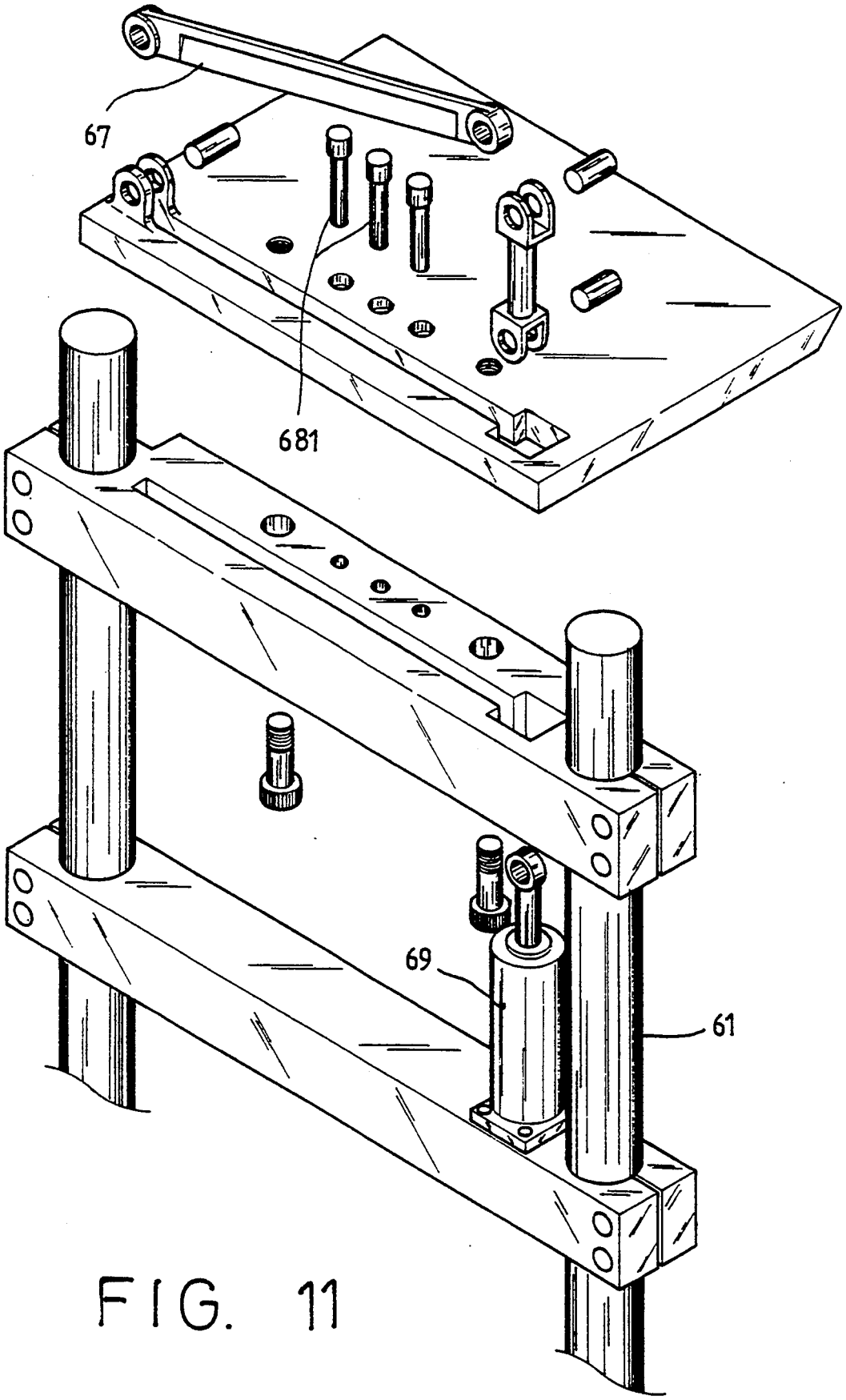
FIG. 11 is an exploded perspective view illustrating the structure of the cutting device.
Figure 12:
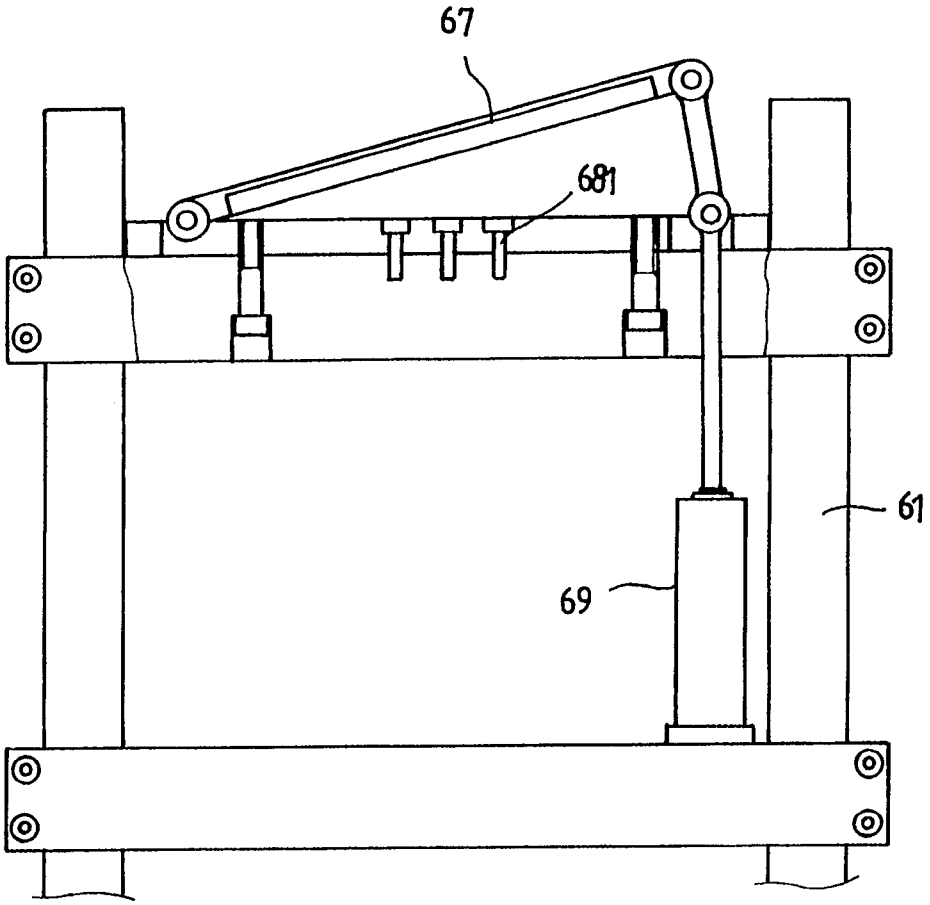
FIG. 12 is a plan view of the cutting device.

After being pressed and hemmed, cloth 7, with help of a buffering device 3, is further delivered to an automatic cutting device 6, as shown in FIGS. 10–12. The cutting device 6 consists of a set of supporting columns 61 having provided on the upper portion thereof a bearing seat 62 on one end of which a rotary axle 63 is mounted and to the other end is connected a crank arm 64. A driven axle 65 is attached to the outer end of the crank arm 64 and lies on the rotary axle 63. The crank arm 64 is equipped with a lever 66 extending upwards, and operates in the same manner as that of the marking device 2 and therefore need not be described again. Arranged behind the supporting columns 61 is a cutter 67 with one end pivotally connected to a stripping plate 68 affixed on the columns 61. The other end of cutter 67 is connected to a rod end of an air cylinder 69. Sensors 681 are installed on the stripping plate 68 to detect marks imprinted on the cloth 7 passing thereover. Sensors 681 will manipulate the cutter 67 moving down as a mark is detected to cut off cloth 7 at the marked positions to accomplish an automatic ironing and cutting operation.

What is claimed is:

1. A continuous ironing and automatic cutting apparatus, comprising:

cloth roll stand means for rotatively supporting a roll of lining fabric;

marking means for displacing the lining fabric from the roll of lining fabric supported on said cloth roll stand means and continuously imprinting spaced marks thereon;

first buffering means for receiving the marked lining fabric from said marking means;

pressing means for sequentially ironing marked lining fabric portions of predetermined length supplied from said first buffering means and pieces of cloth disposed in alignment with said spaced marks on the lining fabric;

second buffering means for receiving the ironed lining fabric and pieces of cloth from said pressing means;

means for hemming the ironed lining fabric and pieces of cloth supplied from said second buffering means;

third buffering means for receiving the hemmed lining fabric and pieces of cloth from said hemming means; and, cutting means for cutting said lining fabric in pieces responsive to detection of said imprinted marks on said lining fabric.

2. The continuous ironing and automatic cutting apparatus as recited in claim 1 where said cloth roll stand means includes:

a pair of upright columns disposed in spaced parallel relation, each of said pair of upright columns having a middle segment;

a mandrel respectively coupled on opposing ends thereof to said middle segment of each of said pair of upright columns for supporting the roll of lining fabric thereon; and, inclined frame means extending between said pair of upright columns for feeding lining fabric from the roll of lining fabric, said inclined frame including (1) a pair of inclined frame members, each of said inclined frame members being coupled to a respective one of said pair of upright columns, (2) a pair of transverse bar members, each of said transverse bar members extending between said pair of inclined bar members on opposing ends thereof, and (3) a pair of partition members extending between said pair of transverse bar members and slidably coupled thereto for guiding lining fabric passing over said transverse bar members therebetween.

3. The continuous ironing and automatic cutting apparatus as recited in claim 1 where said marking means includes:

a frame;

a first roller rotatively coupled to said frame;

a motor affixed to said frame and drivingly coupled to said first roller;

a second roller rotatively coupled to said frame in contiguous contact with said first roller for displacing lining fabric passed between said first and second rollers;

a disk member axially coupled to one end of said first roller for concurrent rotation therewith, said disk member having a plurality of through openings formed equidistantly in a perimeter portion thereof;

photoelectric switching means for monitoring said rotation of said disk member to sequentially detect each of said plurality of through openings, said photoelectric switching means being affixed to said frame in optical alignment with said perimeter portion of said disk member for generating a control signal responsive to each detection of one of said plurality of through openings; and, punch means affixed to said frame and coupled to said photoelectric switching means for imprinting a mark on the lining fabric responsive to said control signal and thereby providing equidistantly spaced marks on said lining fabric.

4. The continuous ironing and automatic cutting apparatus as recited in claim 1 where each of said first, second and third buffering means including:

a pair of upright column members disposed in spaced parallel relation;

a longitudinally extended housing disposed between said pair of upright column members and secured on opposing longitudinal end walls thereof to an upper portion of a respective one of said pair on upright column members, said housing having a front wall and an opposing rear wall;

an axle member extending through a central portion of each of said front and rear walls and rotatively coupled thereto;

a plate member having a pair of opposing end portions, said plate member being coupled to one end of said axle member at a location intermediate said opposing end portions for pivotal displacement therewith;

a pair of guide rods for supporting lining fabric thereon, each of said guide rods having one end thereof fixedly coupled to a respective one of said opposing end portions of said plate member; and, a sector shaped weight member disposed within said housing and fixedly coupled to said axle member for countering pivotal displacement of said plate member.

5. The continuous ironing and automatic cutting apparatus as recited in claim 1 where each of said cutting means includes:

a frame;

a first roller rotatively coupled to said frame;

a motor affixed to said frame and drivingly coupled to said first roller;

a second roller rotatively coupled to said frame in contiguous contact with said first roller for displacing lining fabric passed between said first and second rollers in a predetermined path;

means for sensing imprinted marks on the lining fabric affixed to said frame, said sensing means generating a control signal responsive to each detection of an imprinted mark;

a cutting blade disposed in parallel relation to said first and second rollers, said cutting blade being pivotally coupled on a first end to said frame and extending therefrom across said predetermined path; and, means for reciprocatingly displacing said cutting blade secured to a second end of said cutting blade, said cutting blade displacement means being coupled to said sensing means for displacement thereof responsive to said control signal to thereby cut the lining fabric in lengths defined by the spacing between imprinted marks.

* * * * *